US005534902A

United States Patent [19]

Hoesly

[11] Patent Number: 5,534,902

[45] Date of Patent: Jul. 9, 1996

[54] HOLDDOWN STRUCTURES FOR RECORDING MEDIUM HAVING CURL

[75] Inventor: David D. Hoesly, Webster, N.Y.

[73] Assignee: Xerox Corporation, Stamford, Conn.

[21] Appl. No.: 221,675

[22] Filed: Apr. 1, 1994

[51] Int. Cl.[6] ..... B41J 2/01; B41J 13/10

[52] U.S. Cl. ..... 347/104; 271/240; 271/278; 400/645

[58] Field of Search ..... 347/104, 37, 8; 400/642, 645, 645.1, 645.3, 645.4, 645.5, 320, 352; 271/238, 240, 236, 306, 278

[56] References Cited

U.S. PATENT DOCUMENTS

| | | | |
|---|---|---|---|
| 1,780,346 | 11/1930 | Eckhard | 271/240 |
| 2,658,600 | 11/1953 | Fleming | 400/642 |
| 3,129,802 | 4/1964 | Engle | 400/645 |
| 3,934,872 | 1/1976 | Honkawa | 271/161 X |
| 5,015,109 | 5/1991 | Brandon | 400/642 X |
| 5,065,169 | 11/1991 | Vincent et al. | 347/8 |
| 5,163,674 | 11/1992 | Parks | 271/274 |
| 5,265,856 | 11/1993 | Walker | 271/3.1 |
| 5,368,403 | 11/1994 | Broder et al. . | |

*Primary Examiner*—Joseph W. Hartary
*Attorney, Agent, or Firm*—Daniel J. Krieger

[57] ABSTRACT

A recording medium holddown apparatus for holding down a recording medium traversing along a path on a platen in a post-printing area of a printer. The recording medium holddown apparatus includes a first and second holddown member located above the platen to force a recording medium having any curl flat against the platen to thereby prevent problems associated with curl such as contamination of the printhead nozzles, ink smear, paper misregistration, and carriage hangup. In addition to the holddown members, a first and second runner are disposed on a carriage carrying the printhead across the recording medium for printing. The first and second runners have upturned ends to intercept any curl of the recording medium to further avoid problems associated with recording medium curl.

27 Claims, 3 Drawing Sheets

HOLDDOWN STRUCTURES FOR RECORDING MEDIUM HAVING CURL

FIELD OF THE INVENTION

This invention relates generally to liquid ink jet printers and more particularly to holding down a recording medium in a post-printing area to reduce or prevent problems resulting from curl in the recording medium.

BACKGROUND OF THE INVENTION

An ink jet printer of the type frequently referred to as "drop-on-demand" type has at least one printhead from which droplets of ink are directed towards a recording medium. Within the printhead, the ink is contained in a plurality of channels. Power pulses cause the droplets of ink to be expelled, as required, from orifices at the ends of the channels.

In a thermal ink jet printer, the power pulses are usually produced by resistors, each located in a respective one of the channels, which are individually addressable to heat and vaporize ink in the channels. As voltage is applied across a selected resistor, a vapor bubble grows in that particular channel and ink bulges from the channel orifice. At that stage, the bubble begins to collapse. The ink within the channel retracts and separates from the bulging ink which forms a droplet moving in a direction away from the channel orifice and towards the recording medium. The channel is then re-filled by capillary action, which in turn draws ink from a supply container. Operation of a thermal ink jet printer is described in, for example, U.S. Pat. No. 4,849,774.

One particular form of thermal ink jet printer is described in U.S. Pat. No. 4,638,337. That printer is of the carriage type and has a plurality of printheads, each with its own ink supply cartridge, mounted on a reciprocating carriage. The channel orifices in each printhead are aligned perpendicularly to the line of movement of the carriage and a swath of information is printed on the stationary recording medium as the carriage is moved in one direction. The recording medium is then stepped, perpendicularly to the line of carriage movement, by a distance equal to the width of the printed swath. The carriage is then moved in the reverse direction to print another swath of information.

Typically, the recording medium is moved through the printer by a first sheet handling device using friction rollers having high surface friction characteristics relative to the friction between the sheets of the recording medium in a stack or ream. Either bottom document feeders or top document feeders are used to feed the recording medium to a printing zone characterized by traversal of the printhead therethrough during printing.

A second sheet handling device continues to move the recording medium from the printing zone into a catch tray after the first sheet handling device can no longer move the recording medium through the printing zone. The second handling device can include a drive roller and an idler roller. The drive roller has a high friction surface which contacts the bottom side or non-image side of the recording medium and provides the transporting force for the recording medium. The idler roller is rotatably mounted above the recording medium path of movement with the idler roller axis being parallel to the axis of the drive roller. The idler roller teeth are urged into contact with the surface of the drive roller to form a driving nip by either gravity or spring, so that the idler teeth apply a predetermined force that is substantially normal to the drive roller surface for driving the printed recording medium into the catch tray.

Due to a minimum carriage size necessary to carry the printheads, the recording medium is not held to the platen between where the recording medium exits the printing zone and where the recording medium reaches the second handling device. This area, where no holddown of the recording medium occurs, presents special problems, since the printhead to paper gap is small. The face of the printhead or worse, the carriage holding the printhead, can contact the recording medium if the recording medium does not lay flat in the printing area. For instance, silica coated papers, which tend to curl toward the coated side (especially in humid conditions) can contact the face of the printhead or even the carriage itself. When this occurs various problems result, such as: paper dust or silica dust which can be deposited on the face of printhead by contact with paper may contaminate the nozzles; ink can smear from the face of the printhead onto the edge of the paper; the paper can be forced out of registration when the paper "catches" on the printhead or carriage; printhead holders can be forced out of alignment; and the motion of the carriage can be impeded during the scan.

In U.S. Pat. No. 5,065,169 to Vincent et al., a device to assure paper flatness and pen-to-paper spacing during printing is described. A carriage mounted to carry an ink jet pen across a sheet for printing includes a skidlike spacer to ride upon the printed surface. The spacer maintains a preselected spacing between the pen and the printed surface and, also maintains paper flatness at the localized area of printing.

U.S. Pat. No. 5,163,674 to Parks describes transportation of a recording medium with wet images without degradation of print quality by a drive means comprising a drive roller and a toothed idler roller. The toothed idler roller has spaced teeth with rounded distal ends which extend from a hub to form a nip with the drive roller through which the recording medium is transported.

U.S. Pat. No. 5,265,856 describes a sheet feeder for a copying machine. The sheet feeder, such as a recirculating document handler for a document machine, includes movable sheet flattening guide arms for flattening out upturned sheet corner dog-ears in the leading edges of a document sheet as each sheet is fed from the stacking tray of the document handler.

SUMMARY OF THE INVENTION

In accordance with one aspect of the present invention, there is provided a recording medium holddown apparatus for a recording medium traversing along a paper path on a platen in a post-printing area of a printer. The post-printing area includes a middle zone and side-edge zones where the side-edge zones correspond to anticipated locations of the side edges of the recording medium traversing through the post-printing area. The recording medium holddown apparatus includes a first holddown member disposed in one of the side-edge zones. The first holddown member includes a first edge portion spaced a distance from the platen defining a first space and a second edge portion extending from said first edge portion and angled with respect to the platen to define a second space between the platen and said second edge portion to direct the recording medium into the first space upon traversal of the recording medium through the post-printing area.

Pursuant to another aspect of the present invention, there is provided a recording medium holddown apparatus for a recording medium traversing along a paper path on a platen in a post-printing area of a printer having a printhead with an array of nozzles arranged on a front face for printing a swath-wide image. The printhead is carried by a carriage travelling orthogonally to the paper path. The post-printing area includes a middle zone and side-edge zones where the side-edge zones correspond to anticipated locations of the side edges of the recording medium traversing through the post-printing area. The recording medium holddown apparatus includes a first holddown member disposed in one of the side-edge zones. The first holddown member includes a first edge portion spaced a distance from the platen defining a first space and a second edge portion extending from the first edge portion and angled with respect to the platen to define a second space between the platen and the second edge portion to direct the recording medium into the first space upon traversal of the recording medium through the post-printing area. The recording medium holddown apparatus further includes a first runner disposed on the printhead carriage in a direction substantially orthogonal to the paper path. The first runner includes a middle portion, a first end and a second end. The middle portion extends in front of the printhead face. The first end and the second end extend behind the printhead face to force the recording medium beneath the carriage during a printing operation.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE INVENTION

Figure 1:
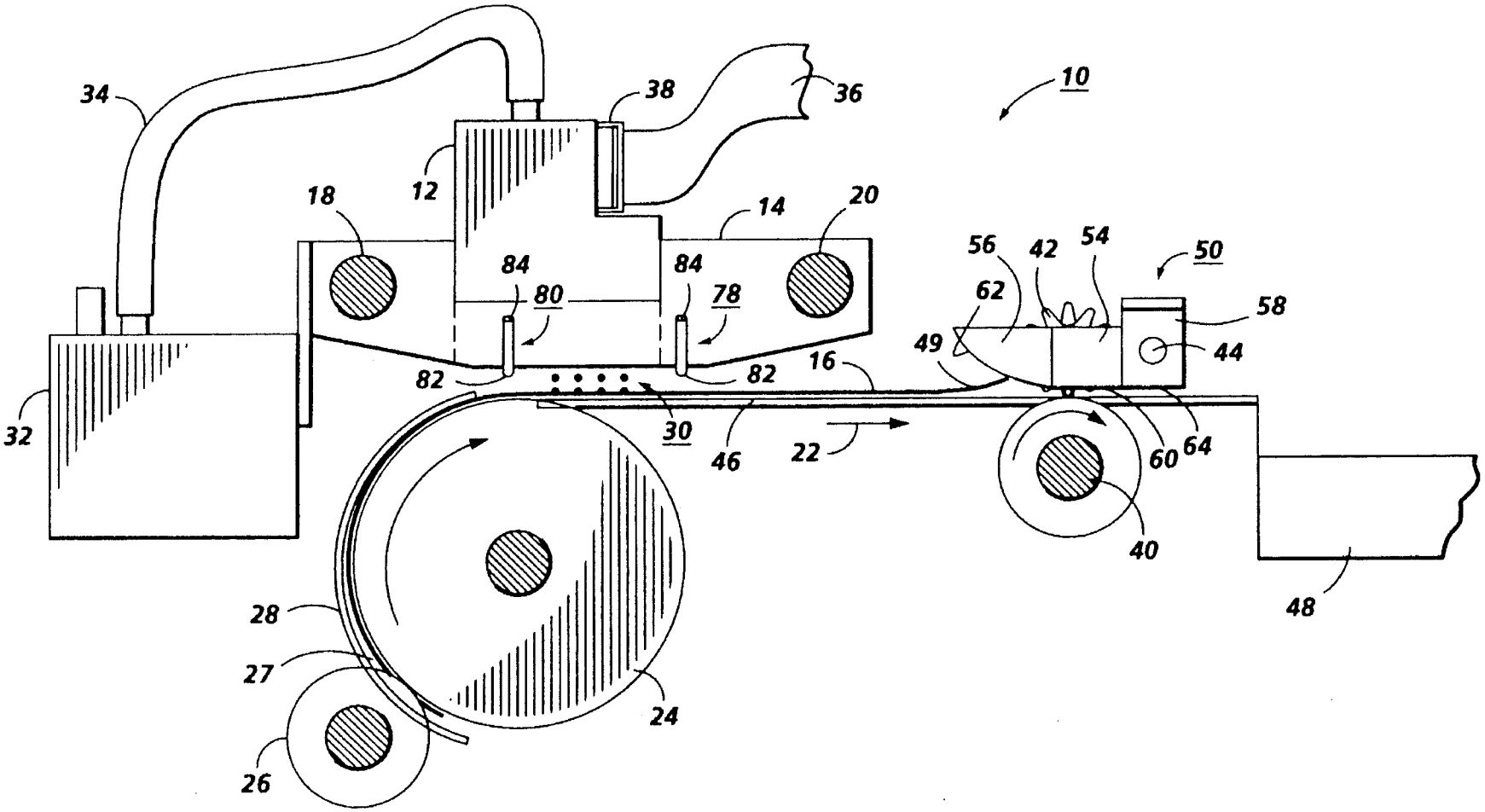
FIG. 1 is a schematic side elevation view of an ink jet printer showing the paper holddown structures of the present invention.

Although the images discussed herein may be printed directly on a recording medium such as paper by an ink jet printer or transferred thereto by a liquid development process in either an electrographic reproducing machine or an electrophotographic copier or printer, the description of the present invention will be described in the environment of an ink jet printer such as that shown in FIG. 1. FIG. 1 illustrates a schematic representation of a thermal ink jet printer 10 in a side elevation view. A translating ink jet printhead 12 printing black or colored ink is supported by a carriage 14 which moves back and forth across a recording medium 16 on a first guide rail 18 and a second guide rail 20. Multiple printheads printing different colors are also within the scope of this invention. The recording medium 16 is moved along a recording medium path in the printer in the direction noted by the arrow 22 and the printhead 12 is moved orthogonally thereto. The recording medium 16 is fed from a tray by a document feeder (not shown) one sheet at a time to a drive roll 24 cooperating with a pinch roll 26. The recording medium 16 is then transported by the drive roll 24 and the pinch roll 26 into a chute 27 defined by the drive roll 24 and a guide member 28.

The recording medium path falls directly underneath the printhead 12 at which point ink droplets 30 are deposited by an array of ink nozzles arranged on a front face of the printhead upon the recording medium 16. The front face of the printhead is substantially parallel to the recording medium. The carriage 14, travelling orthogonally to the recording medium 16, deposits the ink droplets 30 upon the page in an imagewise fashion. The printhead 12 receives ink from an ink tank 32 through an ink tube 34. The image deposited upon the recording medium 16 is controlled by a controller known to those skilled in the art by electrical signals traveling through a ribbon cable 36 to a plug 38 connected to the printhead 12. Before the recording medium 16 has completely left control of the drive roll 24 and the pinch roll 26, an exit roller 40 in combination with a plurality of weighted or spring loaded star wheels 42 connected to a star wheel rail 44 picks up the leading edge of the recording medium 16. The exit roller 40 and star wheels 42 continue to pull the recording medium 16 across a platen 46 for eventual deposit into an output tray 48 upon completion of printing.

As can be seen in FIG. 1, as the recording medium exits from between the drive roll 24 and the pinch roll 26, the recording medium is fed out onto the platen 46 which is substantially flat where the ink jet image is produced upon the paper down from the scanning carriage. The drive roll 24 and pinch roll 26 include a precise recording medium advance mechanism which indexes the recording medium 16 forward by the width of one printed swath of the printhead once the carriage holding the printheads has completed its scan. Due to a minimum carriage size needed to carry the printhead 12, the recording medium 16 is not held down between the point where the recording medium leaves the guide member 28 and where the recording medium reaches the star wheels 42 and exit roller 40 for a final deposit in the output tray 48.

Many recording mediums especially silica coated paper, which is widely used in ink jet printing, can develop a curl especially when the humidity is high. Because of this curl, an edge or edges of the recording medium may touch the front face of the printhead 12 or may even contact the carriage 14 as the carriage 14 moves across the paper.

When recording mediums curl, various problems result. For instance, paper dust and/or silica dust can be deposited on the front face of the printhead and contaminate the printhead nozzle. In addition, smearing of ink from the face of the printhead onto the paper edges can also occur. If the curl is severe enough, the paper can be moved out of registration when it catches on the printhead or carriage. Such curl can also move the printhead holders out of alignment and the movement of the carriage can also be impeded part way through its scan. Moreover, if the curl is severe enough, either from humidity or from the wetness of the paper due to depositing of liquid ink thereon, the paper may not enter the nip defined by the star wheels 42 and the exit roller 40. For instance, it has been observed that the leading edge of the paper can be as much as one-half an inch above the platen 46.

Figure 2:
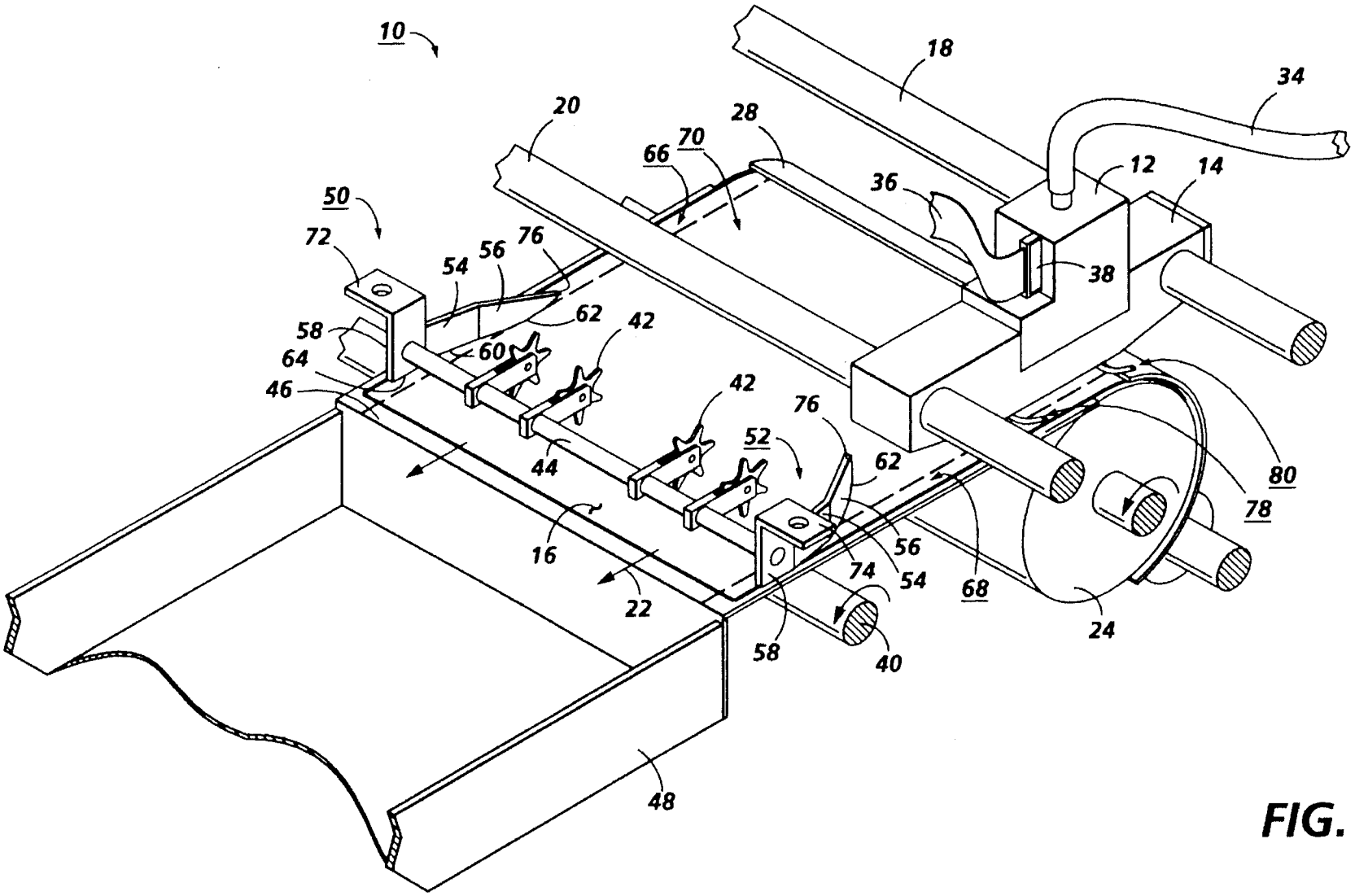
FIG. 2 is a schematic perspective view of an ink jet printer showing the paper holddown structures of the present invention.

To prevent a curl 49 of the recording medium 16 (see FIG. 1) from causing problems, the recording medium 16 is guided into the nip between the exit roller 40 and the star wheels 42 by a first holddown member 50 and a second holddown member 52 as illustrated in both FIG. 1 and FIG. 2. The first holddown member 50 and the second holddown member 52 are spaced above the platen 46 a sufficient distance so that the recording medium 16 can pass underneath each of the members thereof.

The first holddown member 50 and the second holddown member 52 are essentially identical pieces of metal cut and bent to shape except for being mirror images of one another. The holddown members could also be formed of moldable material, such as plastic. Consequently, a description of the first holddown member 50 is adequate to describe this feature of the present invention. As can be seen in FIG. 1, the first holddown member 50 includes a first portion 54, a second portion 56 extending from the first potion 54 towards the carriage 14, and a third portion 58 extending from the first portion 54 towards the output tray 48. The first portion 54 includes a first edge portion 60 which is spaced a distance from the platen 46. The first edge portion 60 is substantially parallel to the platen 46 and defines a space therebetween sufficiently large to allow the recording medium to pass therethrough. The first edge portion 60 need not be substantially parallel to the platen 46, however, but can be slightly angled with respect to the platen. The second portion 56 includes a second edge portion 62 which is angled with respect to the platen 46 forming an angle with the platen to thereby define a second space between the platen and the second edge portion 62. The curl 49, at the front end of the recording medium 16, contacts the second edge portion 62 during travel along the path 22. The recording medium is subsequently forced by the drive roller 24 and pinch roller 26 into the space defined by the first edge portion 60 and the platen 46 which causes the curl to flatten out. The third portion 58 includes a third edge portion 64 which is essentially parallel to the top surface of the platen 46. The third edge portion 58 maintains the flatness of the recording medium 16 for the nip of the exit roller 40 and the star wheels 42. In addition, by controlling curl at this location, any harmful effect curl might have on the printhead 12 and carriage 14 is reduced.

In addition to the first edge portion 60, the second edge portion 62 and the third edge portion 64 being spaced relative to the platen 46, the first edge portion 60, second edge portion 62 and third edge portion 64 are also angled with respect to the edges of the recording medium 16 and the center or middle portion of the recording medium 16. Bends made in the holddown members create the angles.

As illustrated in FIG. 2, the edges of the recording medium 16 define a first edge zone 66 and a second edge zone 68 with respect to the platen 46. The zones correspond to anticipated locations of the edges of a recording medium during travel across the platen. Each of the first and second edge zones 66 and 68, are defined by the edge of the platen and a dotted line as shown. By knowing the anticipated location of the edges of the recording medium, each of the first and second holddown members 50 and 52, can be placed above the recording medium in a respective zone. In addition to the first and second edge zones, 66 and 68, a middle zone 70 corresponding to the middle portion of the recording medium 16 between the side edge zones is also defined.

Referring to FIG. 2, the first holddown member 50 and the second holddown member 52 are respectively placed in the first edge zone 66 and the second edge zone 68. The second edge portion 62 of the second portion 56 extends towards the middle zone 70 in a transverse direction with respect to a plane normal to the platen to form an angle therebetween. Likewise, the first edge portion 60 of the first portion 54 extends in a transverse direction with respect to the plane normal to the platen to form an angle therebetween towards the middle zone 70 but at less of an angle than the second edge portion 62. The third edge portion 64 is essentially parallel with the anticipated location of the side edge of the recording medium 16.

The second portion 56 extends towards the middle zone 70 to intercept any curl on the recording medium 16 where it is least developed. Consequently, when a recording medium 16 has curl, the curl contacts the second edge portion 62, thereby forcing the recording medium downward towards the platen 46. Once the leading edge of the recording medium 16 passes by the second edge portion 62, the recording medium 16 contacts the first edge portion 60. The first edge portion 60 is slightly angled with respect to the parallel line of the side edge zone 66, thereby intercepting any curl if the side edge is misregistered. Finally, the leading edge of the recording medium 16 runs beneath the third edge portion 64 where the sheet is now held flat against the platen between third edge portion 64 and the top surface of the platen 46. The distance of the third edge portion 64 above the platen is slightly more than the thickness of one sheet of the recording medium 16. This distance, however, should not be so small that forward motion of the recording medium is impeded.

While the holddown portion 50 shown here includes distinct first, second, and third portions 54, 56, and 58 it is within the scope of the invention to make a holddown member which has a continuous curvature which splays into the center or middle zone of the recording medium to accommodate any variations in horizontal registration of the recording medium.

By knowing the edge zones 66 and 68 for various sizes of recording mediums 16, the first holddown member 50 and the second holddown member 52 can be positioned according to the size of a sheet of recording medium 16. Additionally, a support structure for each of the first holddown member 50 and the second holddown member 52 (not shown) which is adjustable can also be used. The support structure can support each of the holddown members by tabs 72 and 74 attached respectively to the third portion 58. In addition, the star wheel rail 44 is also supported by the third portions 58 of respective first holddown member 50 and second holddown member 52. A tip 76, of each of the holddown members 50 and 52, defines how closely the holddown members can be placed with respect to the carriage. Of course, the tips should be located just short of any carriage interference.

Figure 3A:
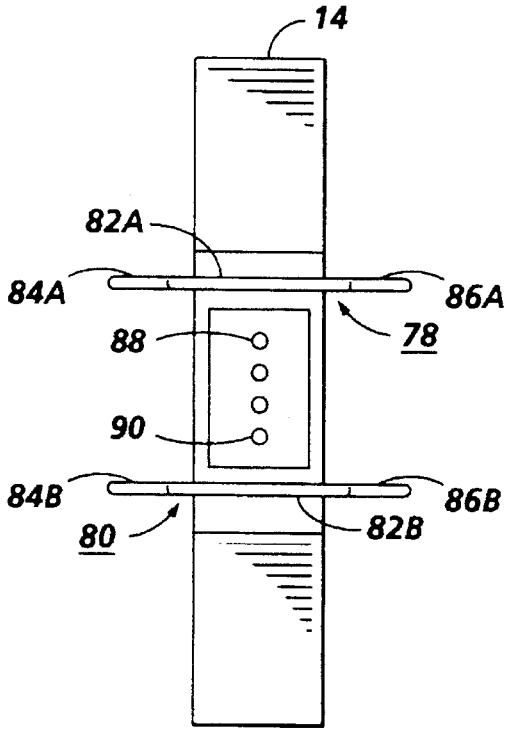
FIG. 3A is a bottom view of a carriage of an ink jet printer showing two runners of the present invention.

The effect of paper curl is also minimized at the carriage 14. A double runner sled consisting of wire forms with upward turned leading and trailing edges with respect to the carriage motion flattens the recording medium 16 so that any edge curl is prevented from touching the front face of the printheads and from hitting the side of the carriage as the carriage traverses orthogonally to the paper path 22. As illustrated in FIGS. 1 and 2 and in detail in FIGS. 3A and 3B, a first runner 78 is attached in front of the printhead nozzles to the underneath side of the carriage 14. This location positions the first runner in front of any ink droplets 30 deposited upon the recording medium 16. The first runner 78 includes a middle portion 82A, a first end portion 84A and a second end portion 86A. Likewise, the second runner 80 also includes a first end portion, a second end portion and a middle portion here having the same numerals but indicated with the suffix B.

Figure 3B:
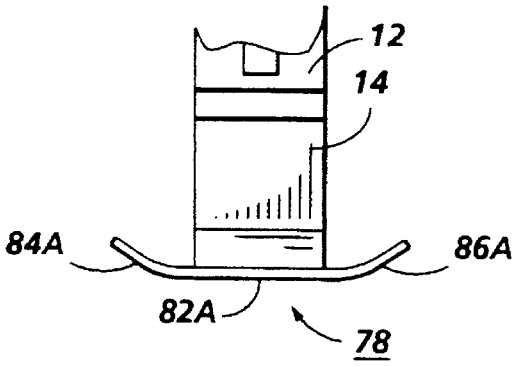
FIG. 3B is a schematic side elevation view of a carriage of an ink jet printer showing a runner of the present invention.

As seen in FIG. 3B, the middle portion 82A, which extends on one side of or in front of the printhead, prevents the recording medium 16 from contacting the face of the printhead 12. The first end portion 84A is upturned and extends on the other side of or behind the printhead so that any excessive curl of the recording medium is intercepted by the first end portions 84A and 84B. Likewise, as shown in FIG. 2, the second end portions 86A and 86B also extend behind the printhead face to thereby intercept any curl of the recording medium 16. Because the upturned portions extend away from the platen, any curl of the recording medium at either the first edge zone 66 or the second edge zone 68 is intercepted as the carriage 14 traverses the guide rails 18 and 20.

FIG. 3B illustrates a front view of the carriage 14 including the first runner 78, the middle portion 82A, extending in front of the printhead face, and the end portions 84A and 86A extending behind the printhead face to intercept any recording medium curl. In the present embodiment, the first runner 78 and the second runner 80 are wires attached to the carriage 14. It is also possible that in place of wires attached to the carriage 14, that the carriage 14 could be formed to include features which accomplish the same function as do the wires. If wires are used, wires should be covered with a low friction material such as polytetrafluorethylene or Teflon™ spaghetti. The carriage as well as the individual runners should be positioned sufficiently far from the recording medium so as not to scrape the imaged area during a carriage scan or during paper advance after a partial scan. The position of the first runner 78 should be slightly more than one swath width forward of a first jet 88 so that the ink has some time to dry before runner 78 crosses the imaged area. The second runner 80 can be placed behind a last jet 90.

In recapitulation, holddown structures for controlling the effects of recording medium curl have been described. It is, therefore, apparent that there has been provided in accordance with the present invention, holddown structures which reduce or prevent the unwanted effects of curl in a recording medium that fully satisfies the aims and advantages hereinbefore set forth. While this invention has been described in conjunction with a specific embodiment thereof, it is evident that many alternatives, modifications, and variations will be apparent to those skilled in the art. For instance, one of the holddown members could be used in combination with some other structure for overcoming curl problems. Accordingly, it is intended to embrace all such alternatives, modifications and variations that fall within the spirit and broad scope of the appended claims.

What is claimed is:

1. An ink jet printer of the type in which liquid ink is deposited on a recording medium having side edges, the recording medium traversing along a recording medium path on a platen including a post-printing area having a first side edge zone and a second side-edge zone and a middle zone located therebetween, the first and second side-edge zones corresponding to anticipated locations of the side edges of the recording medium traversing through the post-printing area, comprising:

a liquid ink printhead, located in the recording medium path before the post-printing area, depositing liquid ink on the recording medium; and a first holddown member disposed in the post-printing area and in one of the first or second side-edge zones, said first holddown member including a first edge portion spaced a distance from the platen defining a first space therebetween and a second edge portion extending from said first edge portion in a transverse direction therewith and toward the middle zone, said second edge portion of said first holddown member disposed between said liquid ink printhead and said first edge portion of said first holddown member.

2. The ink jet printer of claim 1, wherein the platen and said second edge portion of said first holddown member define a second space therebetween to direct the recording medium into the first space defined by the platen and said first edge portion of said first holddown member upon traversal of the recording medium through the post-printing area.

3. The ink jet printer of claim 2, further comprising a second holddown member disposed in the other of the first or second side-edge zones, said second holddown member including a first edge portion spaced a distance from the platen defining a first space therebetween and a second edge portion extending from said first edge portion in a transverse direction thereto and towards the middle zone, said second edge portion of said second holddown member disposed between said liquid ink printhead and said first edge portion of said second holddown member.

4. The ink jet printer of claim 3, wherein the platen and said second edge portion of said second holddown member define a second space therebetween to direct the recording medium into the first space defined by the platen and said first edge portion of said second holddown member upon traversal of the recording medium through the post-printing area.

5. The ink jet printer of claim 4, wherein said first edge portion of said first holddown member is substantially flat and substantially parallel with the platen.

6. The ink jet printer of claim 5, wherein said first edge portion of said second holddown member is substantially flat and substantially parallel with the platen.

7. The ink jet printer of claim 6, wherein said second edge portion of said first holddown member extends in a transverse direction with respect to a plane normal to the platen.

8. The ink jet printer of claim 7, wherein said second edge portion of said second holddown member extends in a transverse direction with respect to a plane normal to the platen.

9. The ink let printer of claim 8, wherein said first edge portion of said first holddown member extends in a transverse direction with respect to a plane parallel to the recording medium path and toward the middle zone.

10. The ink jet printer of claim 9, wherein said first edge portion of said second holddown member extends in a transverse direction with respect to a plane parallel to the recording medium path and toward the middle zone.

11. The ink jet printer of claim 10, wherein said first holddown member further comprises a third edge portion extending from said first edge portion wherein said third edge portion is substantially flat and substantially parallel with the platen and substantially parallel to the recording medium path.

12. The ink jet printer of claim 11, wherein said second holddown member further comprises a third edge portion extending from said first edge portion wherein said third edge portion is substantially flat and substantially parallel with the platen and substantially parallel to the recording medium path.

13. An ink jet printer of the type in which liquid ink is deposited on a recording medium having side edges, the recording medium traversing in a recording medium path on a platen including a post-printing area having a first side edge zone and second side-edge zone and a middle zone located therebetween, the first and second side-edge zones corresponding to anticipated locations of the side edges of the recording medium traversing through the post-printing area, comprising:

a liquid ink printhead, located in the recording medium path before the post-printing area, including an array of nozzles arranged on a front face thereof for printing a swath-wide image, carried by a carriage travelling orthogonally to the recording medium path;

a first holddown member disposed in the post-printing area and one of the first or second side-edge zones, said first holddown member including a first edge portion spaced a distance from the platen defining a first space therebetween and a second edge portion extending from said first edge portion in a transverse direction therewith and toward the middle zone, said second edge portion of said first holddown member disposed between said liquid ink printhead and said first edge portion of said first holddown member; and a first runner disposed on the carriage in a direction substantially orthogonal to the recording medium path, said first runner including a middle portion, a first end and a second end, said first end extending toward one of said first or second side-edge zones, and said second end extending toward the other of said first or second side edge zones, thereby forcing the recording medium beneath the carriage during a printing operation.

14. The ink jet printer of claim 13, further comprising a second holddown member disposed in the other of the first or second side-edge zones, said second holddown member including a first edge portion spaced a distance from the platen defining a first space therebetween and a second edge portion extending from said first edge portion in a transverse direction thereto and towards said middle zone, said second edge portion of said second holddown member disposed between said liquid ink printhead and said first edge portion of said second holddown member.

15. The ink jet printer of claim 13, further comprising a second runner disposed on the carriage in a direction substantially orthogonal to the recording medium path, said second runner including a middle portion, a first end and a second end, said first end extending toward one of said first or second side edge zones, and said second end extending toward the other of said first or second side edge zones, thereby forcing the recording medium beneath the carriage during a printing operation.

16. The ink jet printer of claim 15, wherein said first runner and said second runner comprise a low friction material.

17. The ink jet printer of claim 16, wherein said low friction material comprises polytetrafluoroethylene.

18. The ink jet printer of claim 15, wherein said first runner and said second runner comprises wireforms attached to the carriage.

19. The ink jet printer of claim 15, wherein said first runner and said second runner comprise a low friction tubular material.

20. The ink jet printer of claim 19, wherein said low friction tubular material comprise polytetrafluoroethylene spaghetti.

21. The ink jet printer of claim 15, wherein said first runner is disposed on said printhead on one side of the array of nozzles thereby preceding any printing of the nozzles.

22. The ink jet printer of claim 21, wherein said second runner is disposed on said printhead on the other side of the array of nozzles, thereby following any printing of the nozzles.

23. The ink jet printer of claim 22, wherein said first runner and said second runner comprise a low friction material.

24. The ink jet printer of claim 23, wherein said low friction material comprises polytetrafluoroethylene.

25. The ink jet printer of claim 22, wherein said first runner and said second runner comprise wireforms attached to the carriage.

26. The ink jet printer of claim 22, wherein said first runner and said second runner comprise low friction tubular material.

27. The ink jet printer of claim 26, wherein said low friction tubular material comprise polytetrafluoroethylene spaghetti.

* * * * *